United States Patent [19]

McVoy, Jr.

[11] 4,204,417

[45] May 27, 1980

[54] APPARATUS AND METHOD FOR WINDING ELECTRICAL COILS

[75] Inventor: Charles F. McVoy, Jr., Danville, Ill.

[73] Assignee: General Electric Company, Schenectady, N.Y.

[21] Appl. No.: 945,167

[22] Filed: Sep. 25, 1978

[51] Int. Cl.[2] ..... B21F 3/04

[52] U.S. Cl. ..... 72/206; 72/224; 140/1

[58] Field of Search ..... 140/1; 72/206, 224, 72/225, 234, 235

[56] References Cited

U.S. PATENT DOCUMENTS

| | | | |
|---|---|---|---|
| Re. 11,344 | 6/1893 | Mossberg | 72/224 |
| 1,793,247 | 2/1931 | Piper | 72/224 |
| 3,320,788 | 5/1967 | Meier | 72/224 |
| 3,345,847 | 10/1967 | Schmitt | 72/224 |
| 3,417,593 | 12/1968 | Lewis | 72/211 |
| 3,648,506 | 3/1972 | Caltagirone | 72/206 |

*Primary Examiner*—Lowell A. Larson

*Attorney, Agent, or Firm*—Sidney Greenberg; Lawrence R. Kempton; Philip L. Schlamp

[57] ABSTRACT

Apparatus and method for forming a plurality of round wire strands into rectangular shape and winding the thus formed wires into multiple wire coils. The round wires are drawn from supply spools into a rolling mill for pre-flattening the wires on top and bottom surfaces and then moved in side-by-side arrangement through a second rolling mill for flattening the wires on all four sides to the desired dimensions, after which the rectangular wires are conducted to a multiple coil winding machine.

17 Claims, 7 Drawing Figures

26
24a
25
28
27

22a
23

13
24b
30
24a
12
20
22a
19
32
22b
21
19

APPARATUS AND METHOD FOR WINDING ELECTRICAL COILS

The present invention relates to a method and apparatus for winding electrical coils, and more particularly concerns a method and apparatus for forming multiple electrical coils from a plurality of rectangular wire strands.

It is a general object of the invention to provide for multiple winding of electrical coils having improved space factor.

It is a particular object of the invention to provide a method and apparatus for multiple winding of electrical coils of the above type with rectangular conductor wire wherein a plurality of round wire strands are formed into rectangular shape just prior to being wound into multiple coils.

It is another object of the invention to provide for winding of coils of the above type wherein the wires have relatively uniform rectangular shape and closely controlled dimensions.

Still another object of the invention is to provide for winding coils of the above type wherein the round wire strands are initially flattened on two opposite sides and thereafter flattened on four sides to the desired dimensions.

Other objects and advantages will become apparent from the following description and the appended claims.

With the above objects in view, the present invention in one of its aspects relates to apparatus for winding a plurality of coils of rectangular wire from round wire comprising, in combination, supply means for supplying a plurality of round wire strands, first flattening means for receiving the plurality of round wire strands and flattening two opposite sides thereof, second flattening means for receiving the thus-flattened wire strands in side-by-side arrangement and flattening four sides thereof to form the same into rectangular wire strands, and coil winding means for receiving the rectangular wire strands and simultaneously winding the same into a plurality of coils.

The invention will be better understood from the following description taken in conjunction with the accompanying drawings, in which.

Figure 1:
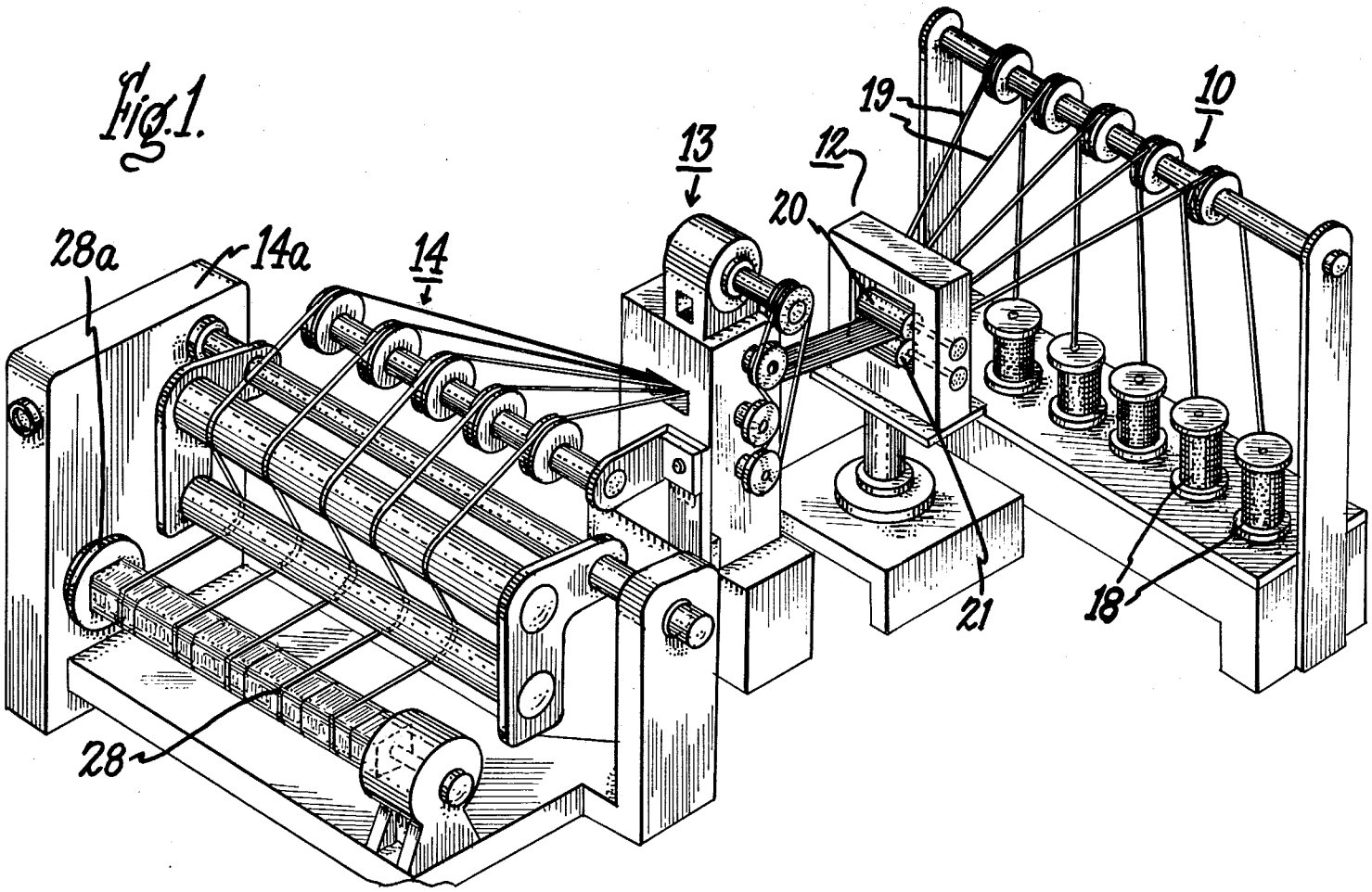
FIG. 1 is a perspective view of apparatus for winding multiple coils of rectangular wire from round wire in accordance with the invention.

Referring now to the drawings, and particularly to FIG. 1, there is shown apparatus for winding multiple coils of rectangular wire from round wire strands in accordance with an embodiment of the invention comprising four main sections, viz., round wire payoff or supply rack 10, first rolling mill assembly 12 for initially flattening the round wire strands on two sides, second rolling mill assembly 13 for forming the initially flattened wire into rectangular shape, and multiple coil winding machine assembly 14 which receives the rectangular wires and winds them in known manner to form multiple coils of rectangular wire.

Figures 5, 6, 7:
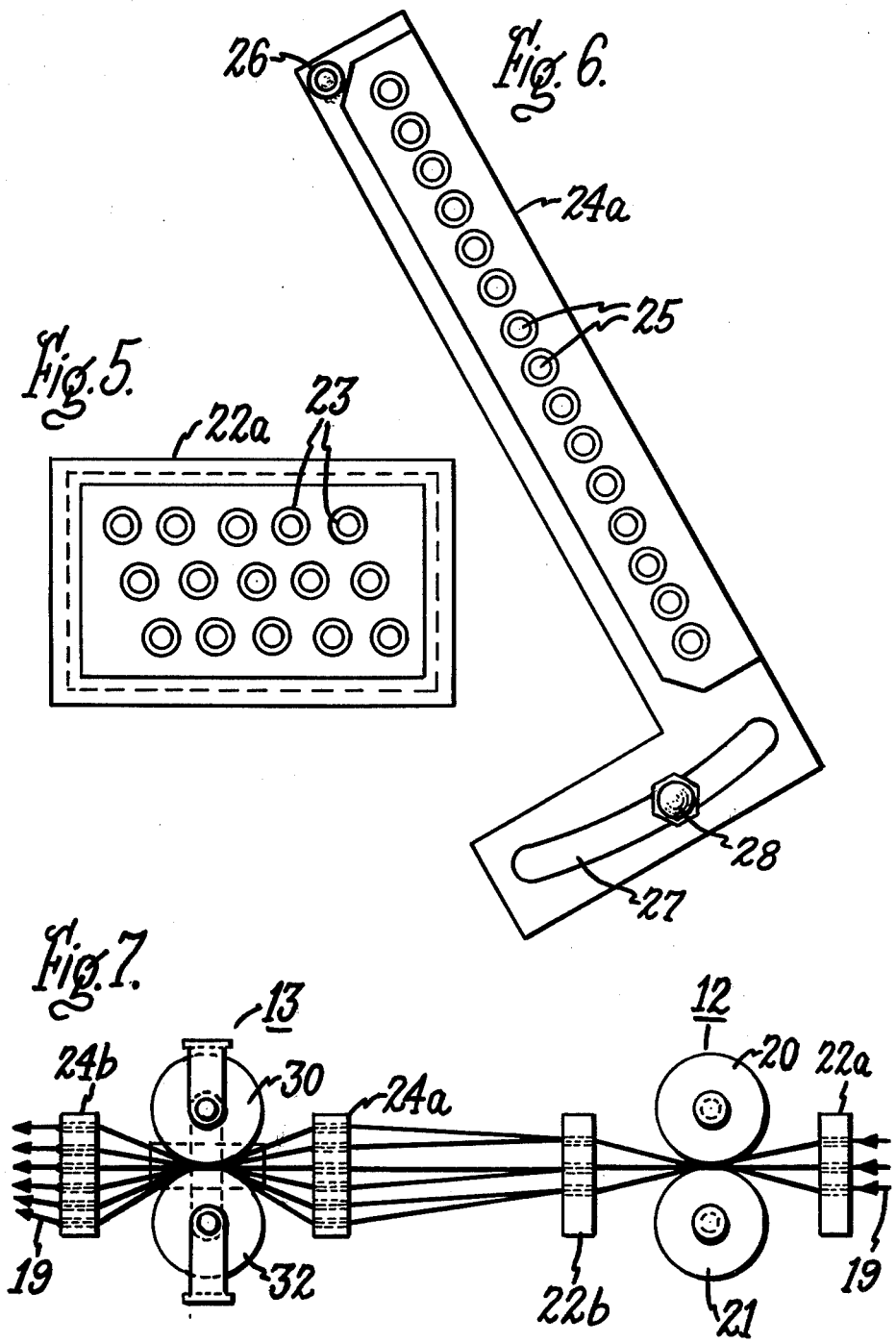
FIG. 5 is an elevational view of a wire guide plate associated with the first flattening device.
FIG. 6 is a similar view of a wire guide plate associated with the second flattening device.
FIG. 7 is a diagrammatic view of a portion of the FIG. 1 apparatus including the wire guides shown in FIGS. 5 and 6.

Wire rack 10, which may be of the type shown and disclosed more specifically in the patent to Caltagirone U.S. Pat. No. 3,648,506 or Mees et al U.S. Pat. No. 3,844,150, both assigned to the same assignee as the present invention, includes a number of spools 18 of round wire, from which strands 19 of round wire are drawn and passed into first rolling (flattening) mill 12 in spaced side-by-side relation. Preferably, perforated wire guide plates **22*a* and 22*b* (see FIG. 5) are placed at the entrance and exit sides of rolling mill 12 as diagrammatically shown in FIG. 7 for maintaining the wire strands in the desired spaced arrangement. As seen in FIG. 5, each guide plate 22*a*, 22*b* is provided with carbide eyelets or bushings 23 through which the individual wire strands pass, the eyelets being horizontally offset from one another to provide the desired spacing of the wire strands as they enter and leave rolling mill 12. The structure, arrangement and operation of wire flattening mill 12 and associated wire guides 22*a*, 22*b*** may be substantially as shown and described in the aforementioned Caltagirone patent, and the disclosure thereof in the latter patent is accordingly incorporated herein by reference.

From the exit side of rolling mill 12 wires 19 extend to second rolling mill 13. Since it is preferred in accordance with the invention to have pre-flattened wires 19 contacting each other as they pass through flattening mill 13, wire guide plates **24*a*, 24*b* of the form shown in FIG. 6 are arranged at the entrance and exit sides of flattening mill 13 for keeping the wires in side-by-side contact as they enter, pass through, and leave mill 13, for reasons explained hereinafter. As seen in FIG. 6, each guide plate 24*a*, 24*b* has a series of vertically spaced carbide eyelets 25 through which the individual wire strands pass. Each guide plate 24*a*, 24*b* is pivotally secured at one end at pivot 26 to a suitable support (not shown) and has a slot 27 at its other end through which bolt 28 or the like passes for securing the guide plate to the aforementioned support in the desired pivoted position. As will be understood, the guide plate 24*a* (24*b*) is pivoted to the angular position at which the wire strands will come into contact with each other when arranged in side-by-side position prior to being drawn into rolling mill 13. In other words, the angular position of guide plate 24*a*** is adjusted such that a vertical line tangent to the right side of a wire in an upper eyelet aperture will be tangent to the left side of the wire in the next lower eyelet aperture.

Figure 3:
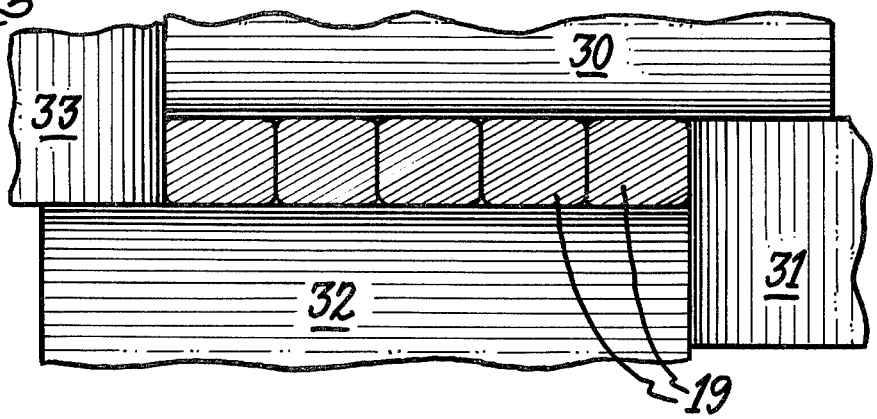
FIG. 3 is a similar view of the wire strands being flattened on four sides by the second rolling mill of the FIG. 1 apparatus.

Second rolling mill 13, which provides for flattening the pre-flattened wires on four sides, conprises (see FIG. 4) four rollers 30, 31, 32 and 33 arranged so that one pair of rollers 30, 32 are respectively mounted on parallel axles 36, 37, while the other pair of rollers 31, 33 are respectively mounted on parallel axles 38, 39. The sets of rollers are arranged as shown in FIG. 4 so as to define a constricted opening 40 through which the pre-flattened wires pass in side-by-side contact while being flattened by rollers 30–33 on all four sides, as shown in FIG. 3.

Figure 4:
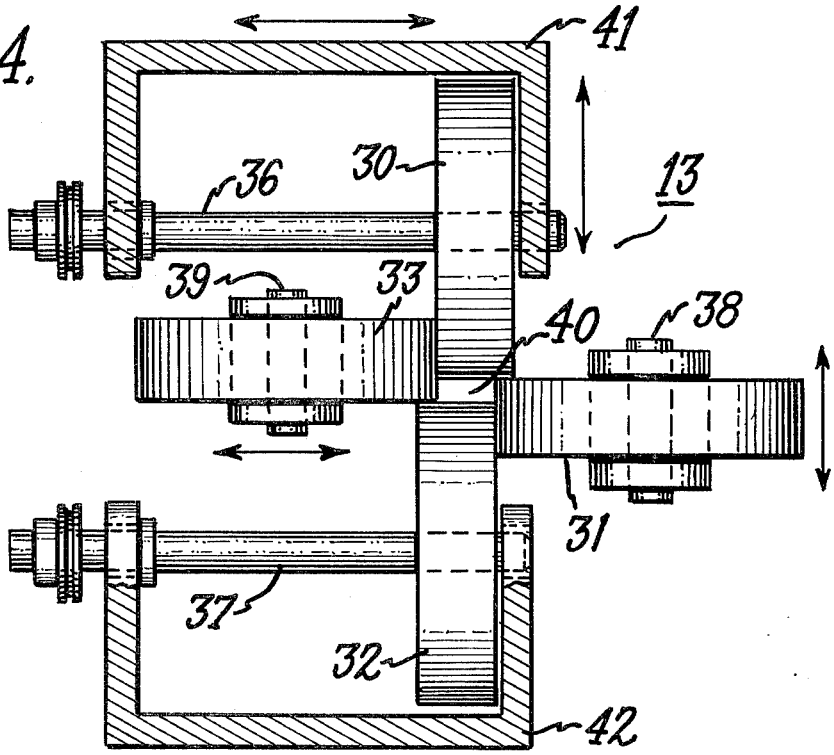
FIG. 4 is a front view in reduced scale of the flattening device depicted in FIG. 3.

Axle 36 for roller 30 is mounted on bearing support 41 which is horizontally and vertically adjustable as indicated by the arrows in FIG. 4, whereas bearing support 42 for roller 32 is preferably fixed in position. Of the pair of rollers 31, 33, roller 31 is vertically adjustable along with the vertical adjustment of support 41 and roller 33 is horizontally adjustable along with the horizontal adjustement of support 41 as indicated by the respective arrows.

Upon leaving rolling mill 13 and passing through guide plate **24*b* (see FIG. 7) the thus formed rectangular wires 19 proceed to multiple coil winding apparatus 14 (see FIG. 1) where, after passing around a plurality of guide rollers, the wires pass to a multiple coil winding arbor 28 driven by head stock 28*a* connected to driving means in housing 14*a*, the wires being wrapped about arbor 28 to form a plurality of layer wound coils of rectangular wire. The coil winding machine 14** may be of known type, such as shown, for example, in the aforementioned Caltagirone and Mees et al patents, and the disclosure thereof in those patents is accordingly incorporated herein by reference.

In a typical apparatus as above described, the pair of flattening rollers 20, 21 of rolling mill 12 are undriven rollers, the rollers being simply adjusted relative to one another to provide a fixed predetermined space between them so that the round wires drawn therethrough will be flattened on top and bottom surfaces. In accordance with the invention, the wires are flattened by rolling mill 12 to such an extent that the resultant overall width (lateral dimension) of each wire is the width desired in the ultimately formed wires, i.e., as produced by rolling mill 13. By virtue of the wire guide plates **22*a*, 22*b*, the wires passing through rolling mill 12 are spaced sufficiently apart (see FIG. 2) so that they do not engage the sides of each other when flattened, which might cause undesired distortion of the wires prior to entering rolling mill 13 and thereby adversely affect the sizing of the wires in rolling mill 13**.

After being thus initially flattened, and being arranged in side-by-side contact by guide plate **24*a* as previously described, the wires enter constricted space 40 of rolling mill 13. The opening 40 is so dimensioned that the entering wires are further flattened on top and bottom surfaces by driven rollers 30, 32, which contact all the wires, the contacting sides of the wires being accordingly flattened by such further pressure of rollers 30, 32, with the non-driven rollers 31, 33 engaging the outer strands of the row of wires, as depicted in FIG. 3**. Such additional flattening of the non-contacting surfaces of the wires results in deforming the wire so that the wire material substantially fills in the remaining spaces between the contacting sides of the wire strands and thereby forms the desired rectangular or square shape.

Figure 2:
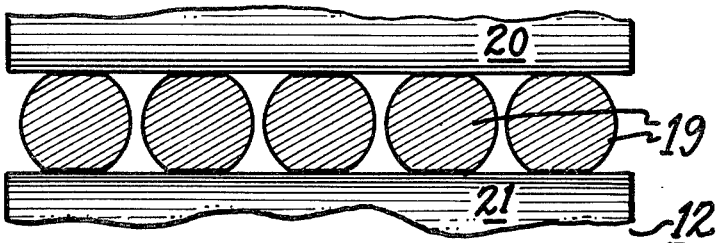
FIG. 2 is an enlarged somewhat schematic view of round wires initially flattened by the first rolling mill of the FIG. 1 apparatus.

While only five wire strands 19 are shown in the apparatus depicted in FIGS. 2 and 3, it will be understood that usually as many as 10–20 wire strands will be drawn through the wire forming and coil winding apparatus.

In a typical apparatus, coil winding machine 14, is driven at a desired speed for winding the coils, and rolling mill 13 is driven through a magnetic or other type of slip clutch so that it feeds the wire at a suitable rate compatible with the operation of the coil winding machine. Such slip clutches are disclosed in the aforementioned Caltagirone and Mees et al patents, and the disclosures thereof are incorporated herein by reference.

Alternatively, rolling mill 13 may be driven at a constant speed to supply rectangular wire at the desired rate, with winding machine 14 being driven through a slip clutch so that the coil winder is capable of winding up wire at the rate supplied by rolling mill 13.

The provision of a pre-flattening step as carried out by rolling mill 12 prior to the final wire forming carried out by rolling mill 13 is a significant feature of the invention. It has been found that in the absence of such pre-flattening of the wire, the variations in lateral dimension of the wire when shaped only by rolling mill 13 are rather large, resulting mainly from the difficulty in guiding the multiple wire strands in uniformly spaced relation into the rolling mill.

While the rollers of rolling mill 12 are described as being non-driven, driving means may be provided therefor where necessary or desirable, as when a large number of wires are to be moved therethrough.

Among the benefits derived from the present invention are that round wire can be converted to rectangular wire as the wire is wound in a wire coiling machine, the variability of dimensions of the rectangular wire is held to a minimum while a wide range of sizes of the wire is made possible, and various flattening ratios can be provided to best suit the coil requirements, thereby obtaining optimum coil performance for lowest material cost. Moreover, since the flattening process by both rolling mills elongates the wire as well as changes its shape, it is possible to start with wire of larger cross section than is desired in the finished conductor, thereby reducing the cost of the wire.

The round wire used in the described apparatus and method is usually pre-coated with conventional or suitable electrical insulation, such as polyamides or polyimides. By virtue of forming rectangular wire coils from insulation-coated round wires in accordance with the invention, a number of advantages are afforded over procedures in which uncoated round wire is first formed into rectangular wire and then coated with insulating material. Thus, less handling of the wire is entailed, which may cause damage to the formed wire; an infinite variety of precise wire dimensions of the coated wire can be obtained by the described process; and less expensive and faster manufacturing processes are made possible.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

I claim:

1. Apparatus for winding a plurality of coils of rectangular wire from round wire comprising, in combination, supply means for supplying a plurality of round wire strands, first flattening means for receiving said plurality of round wire strands and flattening two opposite sides thereof, second flattening means for receiving the thus-flattened wire strands in side-by-side arrangement and flattening four sides thereof to form the same into rectangular wire strands, and coil winding means for receiving said rectangular wire strands and simultaneously winding the same into a plurality of coils.

2. Apparatus as defined in claim 1, including wire guide means for arranging the wire strands in spaced relation for passage through said first flattening means.

3. Apparatus as defined in claim 1, including wire guide means for arranging the wire strands in side-by-side contacting relation for passage through said second flattening means.

4. Apparatus as defined in claim 1, including first wire guide means for arranging the wire strands in spaced relation for passage through said first flattening means, and second wire guide means for arranging the wire strands in side-by-side contacting relation for passage through said second flattening means.

5. Apparatus as defined in claim 4, said coil winding means including drive means for moving the wire strands from said supply means through said first and second flattening means.

6. Apparatus as defined in claim 5, said second flattening means comprising a first pair of opposite rollers and a second pair of opposite rollers defining a wire passage therebetween, said first pair of opposite rollers being arranged to contact the opposite flattened sides of the wire strands, and means for driving said first pair of opposite rollers.

7. Apparatus as defined in claim 6, at least certain rollers of said first and second pair of rollers being adjustable for providing a wire passage therebetween of different sizes and dimensions.

8. Apparatus as defined in claim 4, said first wire guide means comprising a first pair of perforated plates arranged respectively at the entrance and exit sides of said first flattening means, said second wire guide means comprising a second pair of perforated plates arranged respectively at the entrance and exit sides of said second flattening means.

9. A method for winding a plurality of coils of rectangular wire from round wire comprising supplying a plurality of round wire strands in side-by-side arrangement, flattening opposite sides of the thus arranged plurality of wire strands, flattening the thus flattened wire strands simultaneously on four sides to form rectangular wire strands, and simultaneously winding a plurality of coils of said rectangular wire strands.

10. A method as defined in claim 9, wherein said round wire strands have an electrically insulating coating thereon.

11. A method as defined in claim 9, wherein said wire strands are held uniformly spaced from each other in said first mentioned flattening step.

12. A method as defined in claim 9, wherein said winding step operates to move said wire strands during said supplying and both said flattening steps.

13. A method for winding a plurality of coils of rectangular wire from round wire comprising supplying a plurality of round wire strands in side-by-side arrangement, flattening opposite sides of the thus arranged plurality of wire strands, flattening the thus flattened wire strands on four sides to form rectangular wire strands, and simultaneously winding a plurality of coils of said rectangular wire strands, said wire strands being held uniformly spaced from each other in said first mentioned flattening step, said wire strands being held in sideby-side contact in said second mentioned flattening step.

14. A method as defined in claim 13, said wire strands in said first mentioned flattening step being flattened at said opposite sides to a predetermined degree for providing a predetermined lateral dimension of said wire strands, said wire strands in said second mentioned flattening step being further flattened at said opposite sides for forming said wire strands into rectangular shape.

15. A method of winding a plurality of coils of rectangular wire from round wire comprising supplying a plurality of round wire strands in side-by-side arrangement, flattening opposite sides of the thus arranged plurality of wire strands, flattening the thus flattened wire strands on four sides to form rectangular wire strands, and simultaneously winding a plurality of coils of said rectangular wire strands, said first mentioned flattening step comprising moving said round wire strands between a pair of roller members having a predetermined spacing therebetween, and said second mentioned flattening step comprising moving said flattened wire strands between two pairs of oppositely arranged rollers defining a space of predetermined size receiving said wire strands in side-by-side contact.

16. A method as defined in claim 15, wherein said flattened wire strands are further flattened on said opposite sides by one of said pairs of oppositely arranged rollers for thereby flattening the remaining sides of said wire strands.

17. A method for winding a coil of rectangular wire from round wire comprising supplying a round wire strand, flattening opposite sides of said wire strand, flattening the thus flattened wire strand simultaneously on four sides to form a rectangular wire strand, and winding a coil of said rectangular wire strand.

* * * * *